US006697699B2

(12) United States Patent
Gramckow et al.

(10) Patent No.: US 6,697,699 B2
(45) Date of Patent: Feb. 24, 2004

(54) METHOD AND DEVICE FOR INFLUENCING RELEVANT QUALITY PARAMETERS OF A ROLLING STRIP

(75) Inventors: Otto Gramckow, Uttenreuth (DE); Birger Schmidt, Langenau (DE); Markus Schubert, Lennestadt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/015,562

(22) Filed: Dec. 17, 2001

(65) Prior Publication Data

US 2002/0128741 A1 Sep. 12, 2002

Related U.S. Application Data

(63) Continuation of application No. PCT/DE00/01960, filed on Jun. 15, 2000.

(30) Foreign Application Priority Data

Jun. 17, 1999 (DE) ..... 199 27 755
Dec. 10, 1999 (DE) ..... 199 59 553

(51) Int. Cl.[7] ..... G06F 19/00; B21B 37/32

(52) U.S. Cl. ..... 700/154; 700/154; 700/145; 700/90; 72/201; 100/162 B

(58) Field of Search ..... 700/129, 90, 148, 700/150, 154, 145; 100/162 B; 72/201, 199, 200

(56) References Cited

U.S. PATENT DOCUMENTS 3,387,470 A * 6/1968 Smith, Jr. ..... 72/10.7
4,706,480 A * 11/1987 Svatos ..... 72/11.4
5,235,835 A 8/1993 Sakai et al.
5,799,523 A * 9/1998 Seidel et al. ..... 72/9.3
5,855,131 A 1/1999 Schmid et al.
6,014,881 A 1/2000 Imanari

FOREIGN PATENT DOCUMENTS

DE 196 18 995 A 11/1997
SU 710 705 A 1/1980

OTHER PUBLICATIONS

Ginzburg et al., "Application of Coolflex Model for Analysis of Work Roll Thermal Conditions in Hot Strip Mills", in Iron and Steel Engineer, vol. 74, Nr. 11 (Nov. 1997), pp. 38–45.

* cited by examiner

*Primary Examiner*—Jayprakash N. Gandhi
(74) *Attorney, Agent, or Firm*—Sughrue Mion, PLLC

(57) ABSTRACT

Method for influencing relevant quality parameters of a rolling strip, particularly the profile or flatness of the rolling strip, in a roll stand with rolls, by adjusting the crownings of the rolls, i.e., the surface geometry of the rolls in the longitudinal direction of the rolls, wherein the crowning of the rolls is adjusted by an adjustable cooling of the rolls or of their surfaces in longitudinal direction of the rolls. The cooling of the rolls is adjusted by a controller (1) as a function of the actual value ($p_{actual}$) of the crowning and a predetermined setpoint value ($p_{setpoint}$) of the crowning.

18 Claims, 3 Drawing Sheets

METHOD AND DEVICE FOR INFLUENCING RELEVANT QUALITY PARAMETERS OF A ROLLING STRIP

This is a Continuation of International Application PCT/DE00/01960, with an international filing date of Jun. 15, 2000, which was published under PCT Article 21(2) in German, and the complete disclosure of which is incorporated into this application by reference.

FIELD OF AND BACKGROUND OF THE INVENTION

The invention relates to a method and to a device for influencing relevant quality parameters of a rolled strip. More particularly, the invention relates to such a method and device that includes adjusting the crown of the rolls, the crown being the surface geometry of the rolls in the longitudinal direction of the rolls, by adjustably cooling the rolls or their surfaces in the longitudinal direction.

Hot rolled products with temperatures of between 800 and 1200° C. cause noticeable heating and thereby thermal expansion of the work rolls. This results in what is known as a thermal crown of the work rolls, which directly influences thickness, thickness section profile, and flatness of the strip. These are important measures for the quality of the rolling process. The geometry of the strip cross-section is influenced by the geometry of the rolls in a roll stand, i.e., the crown of the rolls. It is known in the art to compensate thermal crown by suitable correction elements, such as screw down, bending force, etc. This method is effective, for instance, in so-called CVC [Continuously Variable Crown Rolls] or taper rolls. However, the preadjustment of CVC rolls is possible only in their unloaded state. They are consequently exclusively used for preadjustment. In addition, this method is extremely complex and costly and reduces the life of a roll stand.

If the adjustment reserves are insufficient, strip quality suffers.

OBJECTS OF THE INVENTION

One object of the invention is to define a method that makes it possible to influence the geometry of rolled strip in a simple manner. A further object of the invention is to provide a device that makes it possible to influence the geometry of rolled strip in a simple manner.

SUMMARY OF THE INVENTION

According to one formulation of the invention, these and other objects are attained by adjusting the crown of the rolls, the crown being the surface geometry of the rolls in a longitudinal direction of the rolls, by adjustably cooling the rolls or their surfaces in the longitudinal direction of the rolls, wherein the cooling of the rolls is adjusted with a controller as a function of an actual value of the crown and a predefined setpoint value of the crown. According to another formulation, the invention provides a device including an adjustable cooling apparatus to adjust the crown of the rolls, and a controller to adjust the cooling apparatus as a function of an actual value of the crown and a predefined setpoint value of the crown.

The relevant quality parameters of rolled strip, particularly the profile or flatness of rolled strip, in a roll stand with rolls are influenced by adjusting the crown of the rolls, i.e., the surface geometry of the rolls in longitudinal direction of the rolls. This adjustment of the crown of the rolls is achieved by adjustable cooling of the rolls, or their surface, in longitudinal direction of the rolls. The cooling of the rolls is adjusted by means of a controller as a function of an actual value of the crown and a predefined setpoint value of the crown.

The control algorithm of the controller is preferably a fuzzy logic algorithm.

According to an advantageous embodiment of the invention, anticipatory control with a view to the next rolled strip or, preferably, the next rolled strips, is achieved analogously to the method disclosed in German Patent DE 196 18 995 A1 and the corresponding U.S. Pat. No. 5,855,131 A. This is highly advantageous since the thermal crown reacts only sluggishly to the environment (water cooling) (controlled system with delay).

According to an advantageous embodiment of the invention, the thermal crown is adjusted in such a way that sufficient adjustment reserves of other (undelayed action) control variables regarding profile and flatness remain available. An associated roll pass schedule pre-calculation supplies the appropriate setpoints for the controller.

BRIEF DESCRIPTION OF THE DRAWINGS

Further advantageous embodiments of the invention will now be described in greater detail with reference to the examples depicted in the drawing in the form of schematic diagrams in which.

DETAILED DESCRIPTION OF THE PREFERRED EMBODIMENTS

Figure 1:
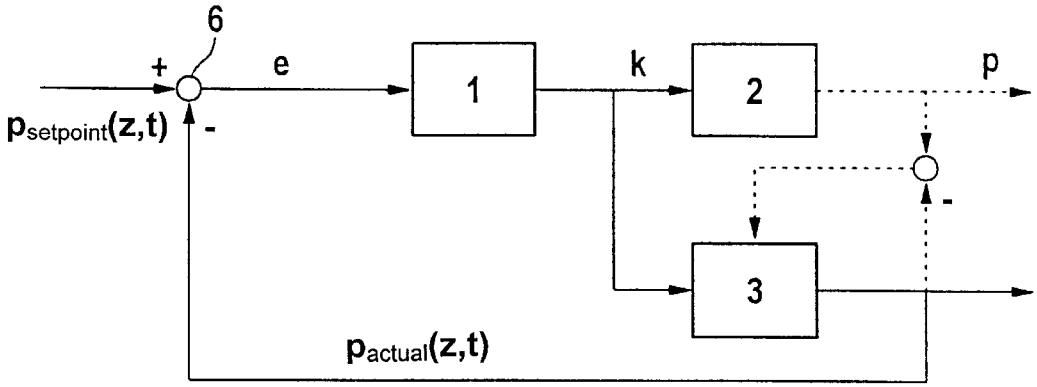
FIG. 1 shows a first embodiment of the device according to the invention.
Figure 2:
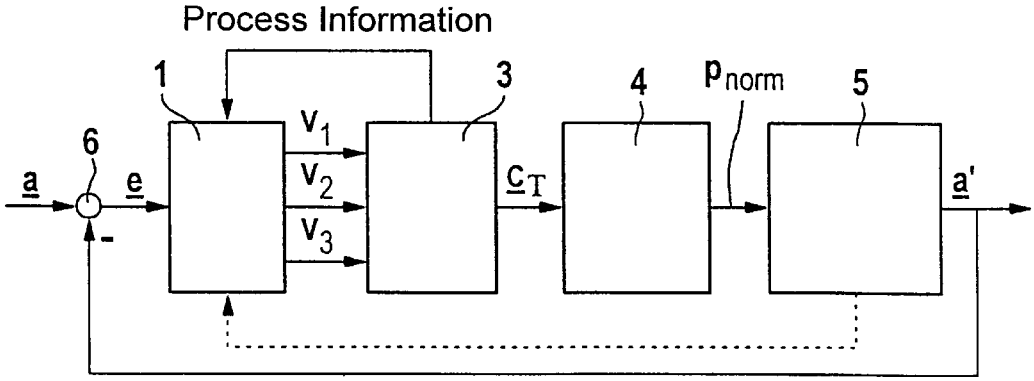
FIG. 2 shows a second embodiment of the device according to the invention.

In FIG. 1, reference numeral 2 designates a controlled system, i.e., a cooling apparatus, and the rolls of a roll stand in which the cooling of the rolls is adjusted according to the value k, which is the output variable of a controller 1. Controller 1 calculates the variable k as a function of the difference between the setpoint value $p_{setpoint}$ (z, t) and an estimated value $P_{actual}$ (z, t) of the crown of the rolls. This estimated value $p_{actual}$ (z, t) of the thermal crown is determined by means of a roll model 3 as a function of the value k. The values $p_{setpoint}$ (z, t), $p_{actual}$ (z, t), p (z, t) and k are normally not scalars but vectors. They advantageously designate a thickness distribution relative to $p_{setpoint}$ (z, t), $p_{actual}$ (z, t) and p (z, t) and a coolant distribution in longitudinal direction of the rolls relative to k. It is particularly advantageous to represent the thickness distribution and the coolant distribution not by individual support points but by polynomials and their parameters. This is illustrated in FIG. 2.

The coolant distribution depending on value k is, for instance, represented by three parameters $v_1$, $v_2$ and $v_3$ (volumetric flow rates of the coolant), which form the output variables of controller 1 and are supplied to roll model 3. In roll model 3 they are used to determine thermal crown $c_T$. Thermal crown $c_T$ is subsequently used to form a standardized value $p_{norm}$ through standardization in a standardization unit 4. This standardized value is supplied to the approximation unit 5.

The approximation unit 5 determines an approximate actual crown value a, which it supplies on the one hand to other applications in the system and returns on the other hand to a comparator 6 upstream from controller 1. Comparator 6 determines a deviation e from the previously calculated approximate crown setpoint value $\underline{a}=a_4x^4+a_2x^2$ and the approximate actual thermal crown value a' and supplies it as an input variable to controller 1. In the exemplary embodiment depicted in FIG. 2, the approximate setpoint values a and a' are thus reduced to the coefficients for the $x^2$ and $x^4$ portion.

The controller setpoint value comprises not only the setpoint parameters for the current strip but always also the setpoint parameters for the following strip or strips.

Figure 3:
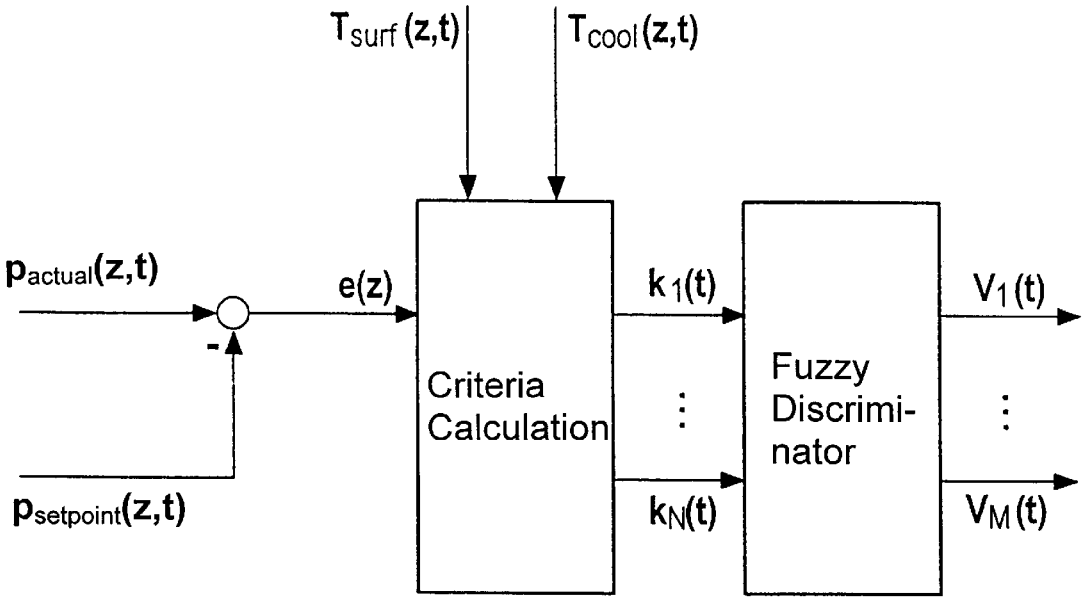
FIG. 3 shows a first embodiment of the controller used in the device according to FIG. 1.
Figure 4:
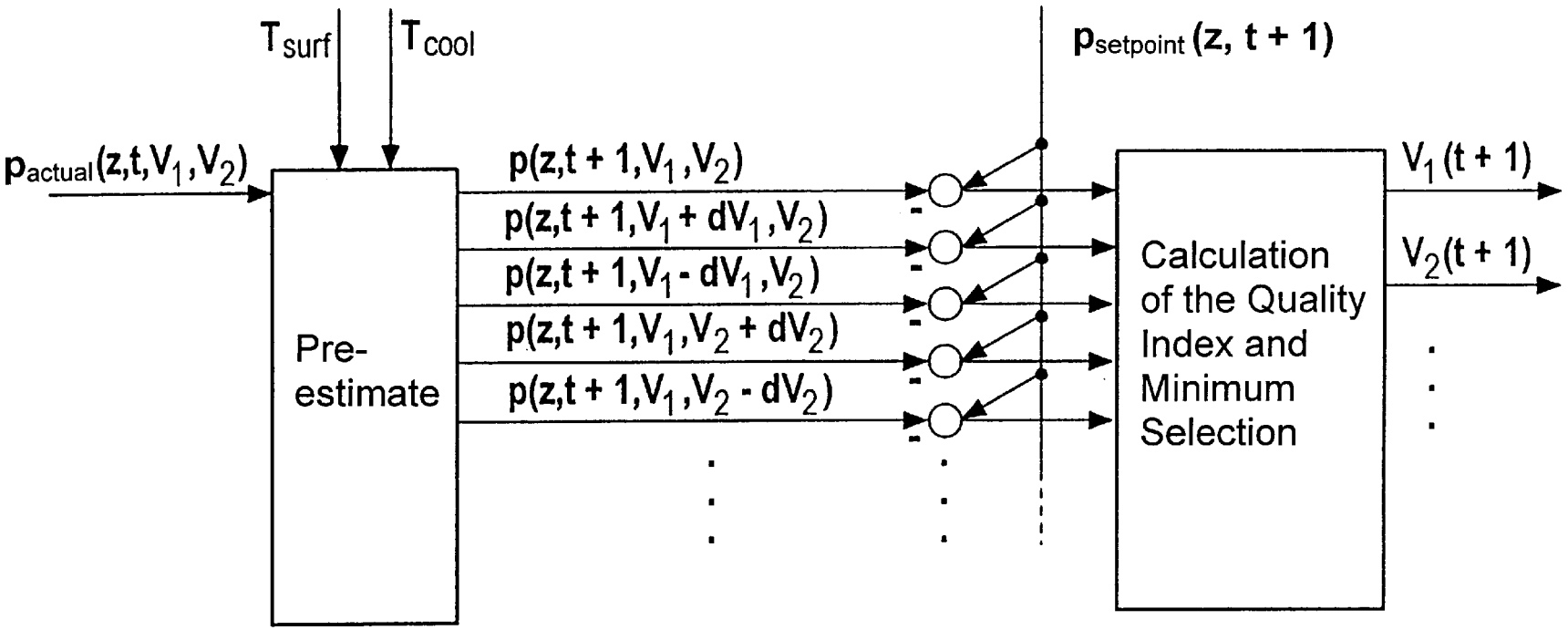
FIG. 4 shows a second embodiment of the controller used in the device according to FIG. 1.

In the devices shown in FIGS. 3 and 4, the shape of the thermal crown of the work rolls is to be influenced by means of specific cooling strategies. It has been shown that the thermal expansion in the center of the roll is not relevant for this purpose, since it can be compensated by the screw down of the rolls. The thermal crown relative to the center of the roll is therefore defined as:

$$\bar{c}_T(z,t)=c_T(z,t)-c_T(\theta,t) \tag{1}$$

The axial position of the roll center is assigned to coordinate z=0.

A setpoint crown $\bar{c}_T^*(z, t)$ is now predefined. It should optimally be reached by thermal crown $\bar{c}_T(z, t)$ for all times t across the width of the rolled strip L in terms of any quality criterion I. This quality criterion can, for instance, be the quality index squared:

$$I(t) = \frac{1}{2} \cdot \int_{-\frac{L}{2}}^{\frac{L}{2}} (\bar{C}_T^*(z, t) - \bar{C}_T^*(z, t))^2 dz \tag{2}$$

The roll temperature model calculates the thermal expansion of the roll as a function of its axial position by solving the three-dimensional Fourier heat conduction equation taking into account the boundary conditions on all surfaces of the roll. It is assumed that the thermal expansion is nearly independent of the circumferential direction, since the areas where azimuthal influences are relevant are found only in a thin layer below the roll surface due to the rotation of the roll. This assumption can be confirmed by three-dimensional numerical reference calculations.

$$c_T(\theta, z, t) \approx c_T(z, t) = \frac{1}{2\pi} \cdot \int_0^{2\pi} c_T(\theta, z, t) d\theta \tag{3}$$

The boundary conditions on the roll surface at r=R essentially depend on the heat input through the roll gap and through the distribution of the cooling water along the roll surface. Other influences, such as the cooling effect of air, are neglected here, but may be included in the consideration, if necessary.

One can now assume that the influences of water-cooling can be modeled through a third-order heat transfer and the influences of the roll gap through a second-order heat transfer. These distributions are superimposed for a total distribution:

$$\alpha(\theta,z,t)=\alpha_c(\theta,z,t) \tag{4}$$

$$q(\theta,z,t)=T_c\alpha_c(\theta,z,t)+q_g(\theta,z,t) \tag{5}$$

and are inserted into the boundary conditions on the roll surface to calculate the temperature distribution:

$$\lambda\frac{\partial T}{\partial r}(R, \theta, z, t) = q(\theta, z, t) - \alpha(\theta, z, t)T(R, \theta, z, t) \triangleq \tilde{q}(\theta, z, t) \tag{6}$$

The heat flow across the neck does not need be considered here since it only has a long-term effect on the thermal deformation of the roll in the strip contact area and thus does not affect the quality of roll crown control.

The distribution of the heat transfer coefficients of the water is determined by the distribution of the specific volumetric flow rate of the cooling water along the roll surface over a generally non-linear characteristic.

$$\alpha_c(\theta,z,t)=F_\alpha(\dot{v}(\theta,z,t,)) \tag{7)}$$

This characteristic may also be subject to other influences, such as the surface temperature of the roll, and must be suitably modeled. The distribution of the volumetric flow rate must be determined by means of a suitable model from the geometric arrangement of the roll, the cooling beam and the nozzles in the roll stand and the N independent volumetric supply flow rates in the individual coolant circuits $V_i(t)$ $$\dot{v}(\theta,z,t)=F_v(\theta,z,\dot{v}_1(t),\dot{v}_2(t), \ldots . \dot{v}_N(t)) \tag{8}$$

The specific heat flow from the roll gap $q_g(\theta,z,t)$ is calculated by a suitable roll gap model.

Plausibility considerations and experimental values lead to a control device that evaluates the current thermal crown and the surface temperature of the roll and derives a decision therefrom regarding the optimum adjustment of the supply pressures $V_i t$). Experience has shown that this control device is highly complex. Many individual strategies flow into it.

A fuzzy controller, the mode of action of which is illustrated in FIG. 3, has proven to be particularly suitable for such a complex control device.

The special feature of the fuzzy controller is that it must be readapted to each problem formulation, cannot be used in the same manner for strategically different cooling concepts, and the adjustment complexity increases with an increasing number of independent coolant circuits (greater than 3) due to the exponentially increasing number of rules.

Thus, as an alternative thereto, the controller may be configured as an energy balance controller under the following assumptions:

- The volumetric flow rates can be incrementally adjusted from the current working point. The increment can be predefined, but is at maximum the control width of the valves within the sampling interval.
- The heat flow within the sampling interval flows only in approximately radial direction. Axial heat flows are negligible.
- The current thermal expansion of the roll and its surface temperature distribution is available either in the form of measured values or in the form of calculated values from an observer. The thermal expansion at an axial position is proportional to the mean temperature averaged in circumferential and radial direction at the axial position:

$$c_T(z,t)=\beta(\bar{T}(z,t)-T_0 \tag{9}$$

$T_0$ in this case is the reference temperature and β the thermal expansion coefficient. This relation can be shown while neglecting mechanical stresses.

For all possible combinations of the volumetric flow rates that can be achieved at a fixed increment from the current working point in the next sampling interval, the associated expected profiles standardized to the strip are approximately calculated using an energy approach, which will be further described below. If each of the volumetric flow rates can be continuously changed in both directions, $3^N$ combinations result. If the coolant circuits can only be turned on or off, $2^N$ combinations result.

The control variable used for the volumetric flow rates is that combination which minimizes to the greatest extent the (squared) area of uncertainty between the expected thermal crown and the setpoint crown in the next time increment. This method corresponds to a method of the steepest descent of the zeroth order, since no sensitivities need to be calculated here.

If one neglects the axial heat flows, the use of Fourier's principle of molecular heat transfer yields for the change in the thermal energy in a very thin slice of the roll at the position:

$$\frac{dE(z)}{dt} = R \cdot dz \cdot \int_0^{2\pi} \tilde{q}(\theta, z, t) d\theta \tag{10}$$

This, however, presumes using the boundary condition $$\frac{dE(z)}{dt} = R \cdot dz \cdot \left\{ T_c \int_0^{2\pi} \alpha_c(\theta, z, t) d\theta + \int_0^{2\pi} q_g(\theta, z, t) d\theta - \int_0^{2\pi} \alpha_c(\theta, z, t) T(R, \theta, z, t) d\theta \right\} \tag{11}$$

The integrals $$\bar{\alpha}_c(z, t) = \int_0^{2\pi} \alpha_c(\theta, z, t) d\theta \tag{12}$$

$$\bar{q}_g(z, t) = \int_0^{2\pi} q_g(\theta, z, t) d\theta \tag{13}$$

$$\bar{q}_T(z, t) = \int_0^{2\pi} \alpha_c(\theta, z, t) T(R, \theta, z, t) d\theta \tag{14}$$

can at least numerically be suitably calculated under the given assumptions. Thus, one finds, taking into account the fact that any change in the thermal energy is synonymous with a change in the mean temperature and thus the thermal expansion:

$$\frac{dE(z)}{dt} = R \cdot dz \cdot \{T_c \cdot \bar{\alpha}_c(z, t) + \bar{q}_g(z, t) - \bar{q}_T(z, t) \tag{15}$$

$$\frac{dE(z)}{dt} = c_w \rho 2\pi R \cdot dz \cdot \frac{d\bar{T}(z)}{dt} \tag{16}$$

$$\frac{dE(z)}{dt} = c_w \rho 2\pi R \cdot dz \cdot \frac{1}{\beta} \frac{dc_T(z)}{dt} \tag{17}$$

With the definition of a mean heat flow across the roll surface $$\bar{\tilde{q}}(z,t) = T_c \bar{\alpha}_c(z,t) + \bar{q}_g(z,t) - \bar{q}_T(z,t) \tag{18}$$

one finds a differential equation for thermal expansion:

$$\frac{dc_T(z)}{dt} = \frac{\beta}{2\pi c_w \rho} \bar{\tilde{q}}(z, t) \tag{19}$$

If one replaces the derivation by a differential quotient and assumes a short sampling time and little change in the boundary conditions, an estimated value is obtained for the change in the thermal expansion at the next sampling instant as a function of the adjusted cooling:

$$\Delta c_T(z, t) \approx \frac{\Delta t \beta}{2\pi c_w \rho} \bar{\tilde{q}}(z, t) \tag{20}$$

This change needs to reflect only qualitatively accurately the conditions for use in the control since it is only the decision basis for the cooling working point to be selected.

The method can be transferred to other cooling concepts. However, the computation effort increases exponentially with the number of coolant circuits that can be switched independently from one another. Instead of calculating the individual combinations, the descent by sensitivities according to the individual volumetric flow rates is also feasible. This would require a sensitivity model, which either calculates directly or estimates by small deflections the sensitivity of the boundary conditions of the changes in the volumetric flow rates of the individual coolant circuits.

As may be seen from the mode of operation of the energy balance controller depicted in FIG. 4, said controller need not be parameterized. It is sufficient to know the physical characteristics of the roll. As in the fuzzy controller, the surface temperature and the current thermal expansion of the roll have to be known. Partial models to calculate the heat flows from the roll gap, as well as the distribution of the heat transfer coefficients of cooling on the roll surface, are a necessary prerequisite.

The symbols used in equations (1) to (20) are listed below:

| | |
|---|---|
| Temperatures | |
| $T(r, \theta, z, t)$ | temperature distribution inside the roll |
| $T_c$ | mean coolant temperature |
| $\bar{T}(z, t)$ | radially and azimuthally averaged temperature |
| $T_0$ | reference temperature for thermal expansion |
| $E(z, t)$ | thermal energy of a slice at the position |
| Boundary conditions | |
| $\alpha(\theta, z, t)$ | heat transfer coefficient on the roll surface |
| $\alpha_c(\theta, z, t)$ | heat transfer coefficient of water cooling on the roll surface |
| $\bar{\alpha}_c(\theta, z, t)$ | azimuthally averaged heat transfer coefficient of water cooling |
| $q(\theta, z, t)$ | imaginary heat flow |
| $q_g(\theta, z, t)$ | heat flow roll gap |
| $\tilde{q}(\theta, z, t)$ | actual heat flow roll surface |
| $\bar{q}(\theta, z, t)$ | averaged imaginary heat flow |
| $\bar{q}_T(\theta, z, t)$ | averaged heat flow feedback cooling |
| $\bar{q}_g(\theta, z, t)$ | averaged heat flow roll gap |
| $\bar{\tilde{q}}(\theta, z, t)$ | actual averaged heat flow roll surface |
| Volumetric flow rates | |
| $V_i(t)$ | total volumetric flow rate of the -th coolant circuit |
| $\dot{v}(\theta, z, t)$ | specific volumetric flow rate on the roll surface |
| $F_\alpha$ | characteristic for converting the specific volumetric flow rate into a heat transfer distribution |
| $F_V K$ | calculation of the specific volumetric flow rate on the roll surface from the total volumetric flow rates |

-continued

| Material values | |
|---|---|
| $c_w$ | thermal capacity |
| $\lambda$ | thermal conductivity |
| $\rho$ | density |
| $\beta$ | thermal expansion coefficient |
| L | width of rolled product |
| **Thermal expansion** | |
| $c_T^*(z, t)$ | setpoint value crown |
| $c_T(z, t)$ | thermal expansion along the axis |
| $\bar{c}_T(z, t)$ | thermal expansion along the axis shifted by the center crown |
| $\Delta c_T(z, t)$ | expected change in the thermal expansion in the next sampling interval |
| $\Delta t$ | sampling time |
| I (t) | quality index |

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. Method for influencing a quality parameter of a rolled strip in a roll stand with rolls, comprising:

adjusting the crown of the rolls, the crown being the surface geometry of the rolls in a longitudinal direction of the rolls, by adjustable cooling of the rolls or of their surfaces in the longitudinal direction of the rolls, wherein the cooling of the rolls is adjusted with a controller as a function of an actual value of the crown and a predefined setpoint value of the crown, and wherein the actual value of the crown is calculated with a roll temperature model that takes into account thermal boundary conditions on surfaces of the roll.

2. Method as claimed in claim 1, wherein the quality parameter is at least one of a profile of the rolled strip or flatness of the rolled strip.

3. Method as claimed in claim 1, wherein the cooling of the rolls is adjusted with the controller as a function of a difference between the actual value of the crown and the predefined setpoint value of the crown.

4. Method as claimed in claim 1, wherein the crown of the rolls is adjusted by variable cooling of the rolls in the longitudinal direction of the rolls.

5. Method as claimed in claim 4, wherein the crown of the rolls is adjusted by a variable coolant amount or by a variable coolant application method.

6. Method as claimed in claim 1, wherein the roll model is an analytical model.

7. Method as claimed in claim 1, wherein the roll model is a neural network or a combination of an analytical model and a neural network.

8. Method as claimed in claim 7, wherein the roll model is a self-configuring neural network.

9. Method as claimed in claim 1, wherein the roll model, or parts of the roll model, is or are adapted to the real process event.

10. Method as claimed in claim 9, wherein the adaptation to the real process event proceeds on-line, using a neural network, through on-line learning process of the neural network.

11. Device for influencing a quality parameter of a rolled strip in a roll stand with rolls, comprising:

an adjustable cooling apparatus to adjust the crown of the rolls, the crown being a surface geometry of the rolls in longitudinal direction of the rolls, a controller to adjust the cooling apparatus as a function of an actual value of the crown and a predefined setpoint value of the crown, and a roll temperature model to calculate the actual value of the crown with reference to thermal boundary conditions on surfaces of the rolls.

12. Device as claimed in claim 11, wherein the quality parameter is at least one of a profile of the rolled strip or flatness of the rolled strip.

13. Device as claimed in claim 11, wherein the controller is a fuzzy controller.

14. Device as claimed in claim 13, wherein the fuzzy rules for the fuzzy controller are specifically adaptable.

15. Device as claimed in claim 11, wherein the controller is an energy balance controller.

16. Device as claimed in claim 15, wherein the volumetric flow rates and their combination are predefined in the energy balance controller.

17. Device as claimed in claim 15, wherein the control variable for the volumetric flow rates minimizes the area of uncertainty between the thermal crown and the setpoint crown.

18. Device as claimed in claim 11, further comprising an approximation unit to further process the actual value of the crown calculated by the roll temperature model prior to being supplied to the controller.

* * * * *